US005871378A

United States Patent [19]

Poiraud et al.

[11] Patent Number: 5,871,378

[45] Date of Patent: Feb. 16, 1999

[54] CONNECTION UNIT FOR TRANSMISSION NETWORKS, IN PARTICULAR FOR TELEPHONE OR COMPUTER NETWORKS

[75] Inventors: Bernard Poiraud, Saint-Romans; Patrice Bret, Saint-Marcellin; Jean-Louis Gonon, Saint-Verand, all of France

[73] Assignee: Arnould Fabrique d'Appareillage Electrique, Saint Marcellin, France

[21] Appl. No.: 848,758

[22] Filed: May 1, 1997

[30] Foreign Application Priority Data

May 3, 1996 [FR] France ..... 96 05576

[51] Int. Cl.[6] ..... H01R 23/02

[52] U.S. Cl. ..... 439/676; 439/409; 439/725

[58] Field of Search ..... 439/344, 409–412, 439/656, 676, 725, 864

[56] References Cited

U.S. PATENT DOCUMENTS

| | | | |
|---|---|---|---|
| 4,463,235 | 7/1984 | Gentric | 200/175 |
| 4,773,867 | 9/1988 | Steven | 439/49 |
| 4,929,190 | 5/1990 | Gonon et al. . | |
| 5,435,747 | 7/1995 | Franckx et al. | 439/409 |
| 5,470,250 | 11/1995 | Hawk et al. | 439/409 |

FOREIGN PATENT DOCUMENTS

| | | | |
|---|---|---|---|
| 2702092 | 9/1994 | France | H01R 4/24 |
| 2702096 | 9/1994 | France | H01R 9/22 |
| 2 734 418 | 11/1996 | France . | |
| WO 96/37016 | 11/1996 | WIPO . | |

*Primary Examiner*—Khiem Nguyen
*Attorney, Agent, or Firm*—Young & Thompson

[57] ABSTRACT

A connection unit for transmission networks includes contact members which cooperate with a conjugate connection unit and connection terminals in an insulative material body, each of which is individually connected to the contact members by electrical conductors and each of which includes at least one connection unit having a circumferentially elongate slot around an axis. A barrel coaxially associated with two connection units circumferentially staggered around one such axis is rotatable about said axis and forces an electrical wire into the slot of each of the connection members. To this end the barrel has, in corresponding relationship to the slot of each of the connection units, a passage adapted to have an electrical wire of this kind engaged in it. For at least one of the barrels, the two connection units associated with the barrel are insulated from each other and each is respectively connected to two different contact members with the result that the barrel corresponds to two different connection terminals. Applications include the socket and the plug of a connector for telephone networks.

11 Claims, 5 Drawing Sheets

CONNECTION UNIT FOR TRANSMISSION NETWORKS, IN PARTICULAR FOR TELEPHONE OR COMPUTER NETWORKS

BACKGROUND OF THE INVENTION

1. Field of the Invention

The present invention is generally concerned with the connectors used to connect a receiver of any kind to a transmission network of any kind and is more particularly, but not necessarily exclusively, directed to the case of telephone or computer networks carrying low currents at a very low voltage.

2. Description of the Prior Art

A connector of this kind includes two conjugate connection units, namely a socket which is designed to be attached to a support of any kind, for example a wall, and a plug which is adapted to be plugged into the socket and which is designed to be fitted to the cable of the receiver to be connected.

Whether it is a socket or a plug, a connection member of this kind includes contact units to cooperate with the conjugate connection unit and connection terminals within an insulative material body individually connected to the aforementioned contact members by electrical conductors and individually adapted to receive one of the electrical wires to be connected.

The present invention is even more particularly directed to the situation in which the connection terminals employed are insulation displacement connection terminals, i.e. connection terminals which themselves assure the local elimination of the insulative material sheath of the electrical wires to be connected if these electrical wires are insulated electrical wires.

This is the case, for example, in the connection socket which is the subject matter of the French patent published under the number 2 702 096 and filed 22 Feb. 1993 under the number 93 01984.

The insulation displacement connection terminals employed each include at least one connection member having a circumferentially elongate slot about an axis with, coaxially associated with two connection members staggered circumferentially about an axis of this kind, a barrel rotatable about said axis and adapted to force an electrical wire into the slot in each of the connection members, the barrel having for this purpose, in corresponding relationship to the slot in each of the connection members, a passage in which an electrical wire can be engaged.

In the French patent No 93 01984 in question, the two connection members associated with the same barrel are in practise electrically connected to each other, one of them connecting one of the electrical wires to be connected, as indicated hereinabove, and the other being used to establish a tap connection at this point, if required.

As a result, each of these barrels of itself corresponds to only one connection terminal, or in other words there are as many barrels as there are connection terminals.

This system has given satisfaction and may continue to do so.

However, given the relatively large number of barrels to be used, it leads to relatively bulky and costly implementations.

A general object of the present invention is an arrangement whereby this disadvantage is significantly reduced and other advantages are obtained.

SUMMARY OF THE INVENTION

To be more precise, the present invention consists in a connection unit for transmission networks of the kind including, on the one hand, contact members adapted to cooperate with a conjugate connection unit and, on the other hand, in an insulative material body, connection terminals each of which is individually connected to the contact members by electrical conductors and each of which includes at least one connection member having a circumferentially elongate slot around an axis, with, coaxially associated with two connection members circumferentially staggered around one such axis, a barrel rotatable about said axis and adapted to force an electrical wire into the slot of each of the connection members, said barrel having to this end, in corresponding relationship to the slot of each of the connection members, a passage adapted to have an electrical wire of this kind engaged in it, wherein, for at least one of the barrels employed, the two connection members associated with the barrel are insulated from each other and each is respectively connected to two different contact members with the result that said barrel of itself corresponds to two different connection terminals.

This is preferably the case for each of the barrels.

In this way the number of barrels to be used is halved.

An advantageous result of this is a significant reduction in the overall size of the system and/or an easier arrangement of the connection terminals, together with a significant reduction in cost.

In the case of a socket, however, there is also a significant reduction in the risk of near-end crosstalk.

In the case of a telephone network, for example, the two electrical wires of the same pair may advantageously be connected to respective connection terminals that are very close together.

All that is necessary for this is that each is engaged in a respective one of the two passages in the same barrel.

While these electrical wires are initially twisted together to minimize crosstalk, the section along which each must be separated from the other in order to be connected to a connection terminal is advantageously short when the invention is used, given the proximity of the two connection terminals concerned, and the risk of local recurrence of crosstalk, which is usually referred to as near-end crosstalk in this case, associated with this separation, is advantageously reduced commensurately.

The features and advantages of the invention will emerge from the following description given by way of example with reference to the accompanying diagrammatic drawings.

DETAILED DESCRIPTION OF THE PREFERRED EMBODIMENTS

FIGS. 1 through 14 concern the situation in which the connection unit of the invention is a connection socket unit 10.

Figure 3:
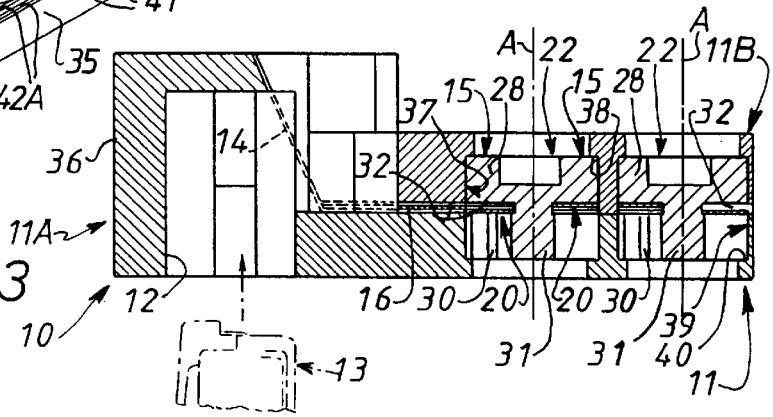
FIG. 3 is a view of it in longitudinal section taken along the line III—III in FIG. 1 and to a larger scale.
Figure 6:
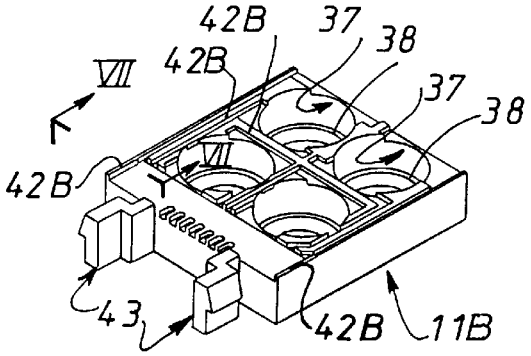
FIG. 6 is another perspective view of the other component part of the insulative material body, to the same scale as FIGS. 1 and 2, shown in isolation and from below, i.e. in the direction of the arrow VI in FIG. 2.
Figure 7:
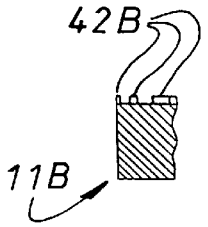
FIG. 7 is a fragmentary view of this part in cross-section taken along the line VII—VII in FIG. 6 and to a larger scale.
Figure 8:
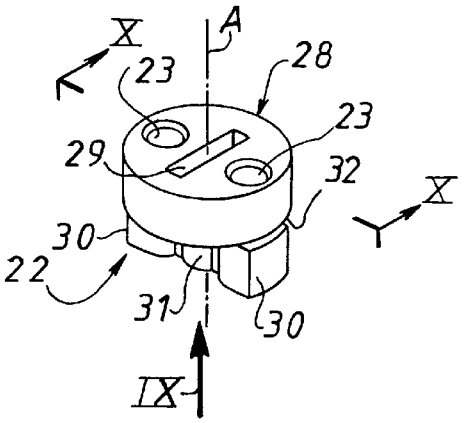
FIG. 8 is a perspective view of one of the barrels of the connection unit of the invention, as seen from above, with the same orientation as it has in FIG. 2.
Figure 10:
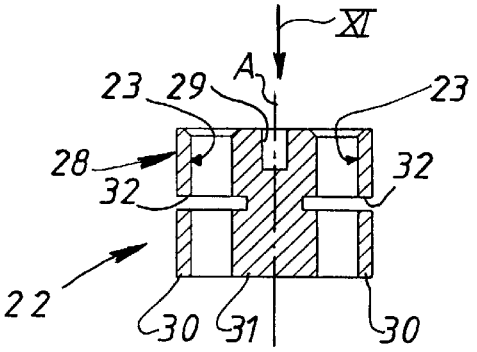
FIG. 10 is a view of it in axial section taken along the line X—X in FIG. 8 and to a larger scale.
Figure 9:
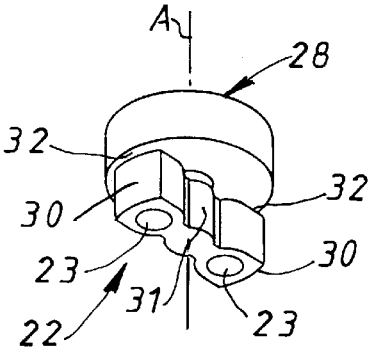
FIG. 9 is another perspective view of this barrel as seen from below, i.e. in the direction of the arrow IX in FIG. 8.

As shown in these figures, the connection socket unit 10 includes, in a manner that is known in itself, within an insulative material body 11, a receptacle 12 adapted to receive a conjugate connection unit, here a connection plug 13, part of which is shown diagrammatically in chain-dotted line in FIG. 3, and in which contact members 14 are operative, for cooperation with the conjugate connection unit that the connection plug 13 constitutes, and connection terminals 15 which, by virtue of arrangements described in more detail hereinafter, are each individually connected to the contact members 14 by electrical conductors 16.

The connection socket unit 10 is designed for use in a transmission network using electrical wires 18.

In the case of a telephone network, for example, the electrical wires 18 are usually twisted two by two to form pairs 19.

Figure 1:
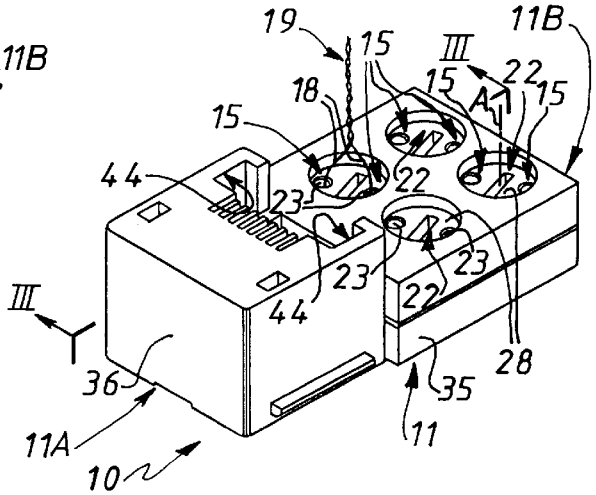
FIG. 1 is a perspective view of a connection unit in accordance with the invention.
Figure 4:
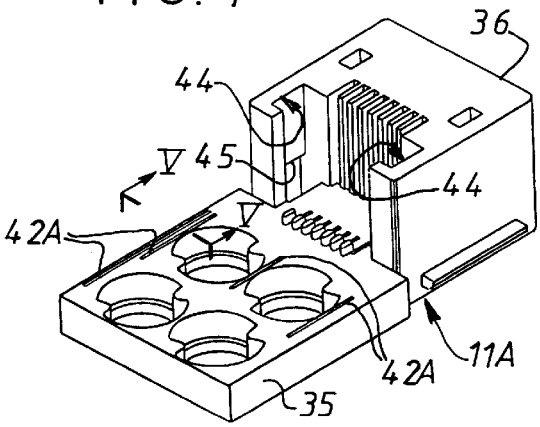
FIG. 4 is another perspective view, to the same scale as FIGS. 1 and 2, of one of the component parts of the insulative material body of the connection unit, shown in isolation and from the opposite end, i.e. in the direction of the arrow IV in FIG. 2.
Figure 5:
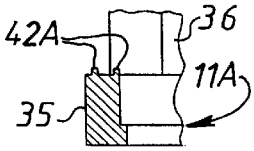
FIG. 5 is a fragmentary cross-sectional view of this part taken along the line V—V in FIG. 4 and to a larger scale.

To avoid overcomplicating the drawings, only one of these pairs 19 of electrical wires 18 is shown in FIG. 1.

For example, there are four pairs 19 of electrical wires 18 and, as shown, twice the number of connection terminals 15 and contact members 14, at the rate of one connection terminal 15 and one contact member 14 per electrical wire 18.

The electrical wires 18 are in practise insulated electrical wires.

In the embodiment shown, the contact members 14 are metal tongues extending somewhat slantwise in the receptacle 12.

The above arrangements are well known in themselves and will therefore not be described in further detail here.

In a manner that is also known in itself, the connection terminals 15 are insulation displacement terminals.

To be more precise, they are connection terminals of the type described in the French patent published under the number 2 623 024 and filed 9 Nov. 1987 under the number 87 15476.

Each connection terminal 15 includes at least one connection member 20 having a circumferentially elongate slot 21 around an axis A with, coaxially associated with two said connection members 20 staggered circumferentially around an axis A of this kind, a barrel 22 which, rotatable about the axis A, is adapted to force an electrical wire 18 into the slot 21 of each of the connection members 20, this barrel 22 having for this purpose, in corresponding relationship to the slot 21 of each of the connection members 20, a passage 23 in which an electrical wire 18 of this kind can be engaged.

Figure 11:
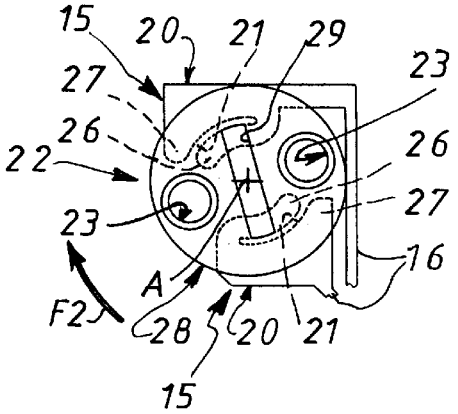
FIG. 11 is a plan view of it as seen in the direction of the arrow XI in FIG. 10, with the two connection members associated with it.
Figure 12:
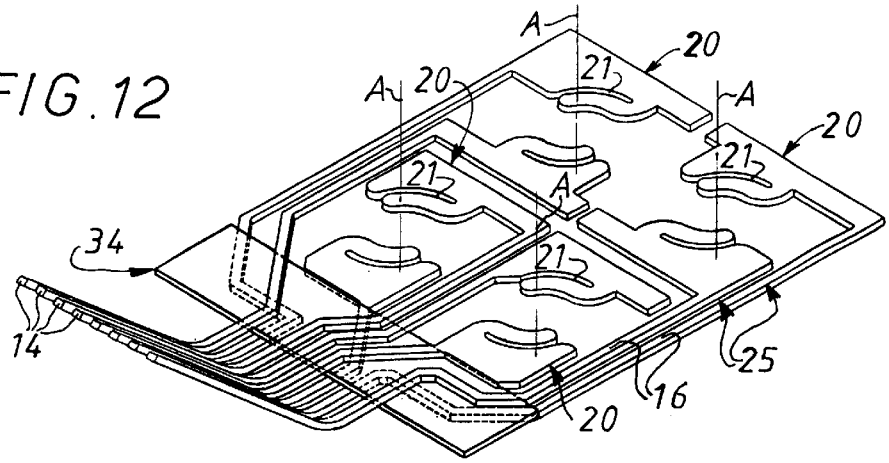
FIG. 12 is a perspective view to a different scale of the blanks from which the various connection members employed in the connection unit of the invention are made.

Axes A are shown diagrammatically in chain-dotted line in FIGS. 1, 2, 3, 8, 9, 10 and 12 and the location of one of them is shown in FIG. 11.

In accordance with the invention, for at least one of the barrels 22 employed, the two connection members 20 associated with the barrel 22 are insulated from each other and each is respectively connected to two different contact members 14 so that the barrel 22 of itself corresponds to two different connection terminals 15.

As shown here, this is preferably the case for each of the barrels 22 employed.

In other words, for eight connection terminals 15 the invention requires only four barrels 22.

In the embodiment shown, and as described in the French patent No 87 15476 previously mentioned, the two connection members 20 associated with the same barrel 22 are flat and they extend transversely to the corresponding axis A.

The two connection members 20 are in practise parts of respective different metal blanks 25 which themselves form, in one piece, the corresponding electrical conductors 16 and, in continuity with the latter, the contact members 14 concerned.

In practise the two connection members 20 associated with the same barrel 22 are in diametrally opposite positions about the corresponding axis A.

All the connection members 20 are globally of the same type.

To define their slot 21, they include two lips 26, 27 one of which, the radially innermost lip 26, extends globally circumferentially, like the slot 21, whereas the other one, the radially outermost lip 27, has a more massive contour.

The outlet of the slot 21 in the connection members 20 is preferably flared outwardly, to facilitate the engagement therein of an electrical wire 18.

The various barrels 22 employed are all identical to each other.

Each includes a circular cross-section cylindrical head 28 which has a diametral slot 29 on its surface, as on the head of a screw, to facilitate actuation in rotation of the system.

The head 28 also includes, eccentrically positioned, the two passages 23 each associated with a respective one of the two connection members 20 concerned.

Like the connection members 20, the passages 23 are in diametrally opposite positions relative to each other and, in the embodiment shown, they are parallel to the corresponding axis A.

For each of the connection members 20 associated with them, the barrels 22 include a deflector 30 which is disposed axially at a lower level than that of the connection members 20, so as to be operative below a connection members 20 of this kind, and through which the corresponding passage 23 extends.

Accordingly, the barrels 22 each include two deflectors 30 which, like the connection members 20 and the passages 23, are disposed at diametrally opposite positions relative to each other.

In practise, the deflectors 30 extend radially, cantilever-fashion and back-to-back from a central core 31 projecting axially from the bottom surface of the head 28 of the barrels 22.

Each of the deflectors 30 is separated from the head 28 by a respective slot 32 which intersects the corresponding passage 23 transversely and within which the connection unit 20 concerned is operative.

It follows from the above that each of the connection terminals 15 includes only one connection member 20 in the embodiment shown and that these connection terminals 15 are associated with the barrels 22 in pairs.

In the embodiment shown, the blanks 25 forming the various connection members 20 are divided into two layers.

As shown here, for example, an insulative material plate 34 is disposed locally between these two layers, at a place where the electrical conductors 16 are grouped together to form the continuous contact members 14.

The insulative material plate 34, which is relatively thin and flat, has a four-sided, in practise rectangular contour in the embodiment shown (FIGS. 2 and 12), and is naturally entirely contained within the overall contour of the body 11.

In practise it is beyond the insulative material plate 34 that the contact members 14 are bent relative to the blanks 25 of which they are part, forming a dihedron with the latter, in order to extend slantwise in the receptacle 12.

In a different embodiment, not shown, each blank 25 is at least locally insulated either by having some of its parts covered with an insulative varnish or by having the insulative synthetic material molded over some of its parts, and the blanks 25 are then stacked or otherwise assembled.

Figure 13:
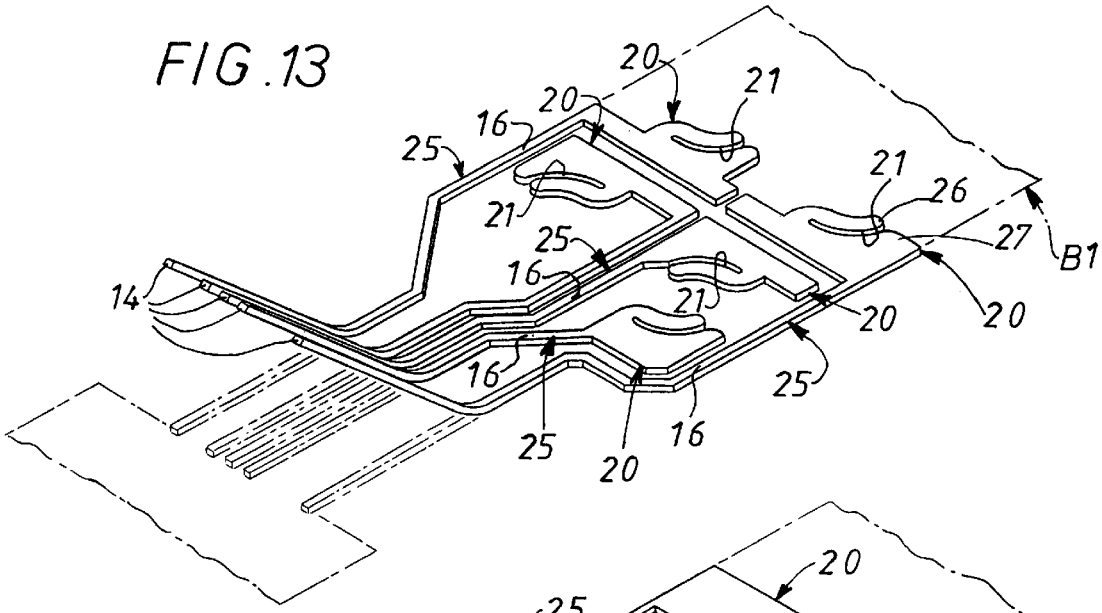
FIG. 13 is a perspective view of a part of these blanks.
Figure 14:
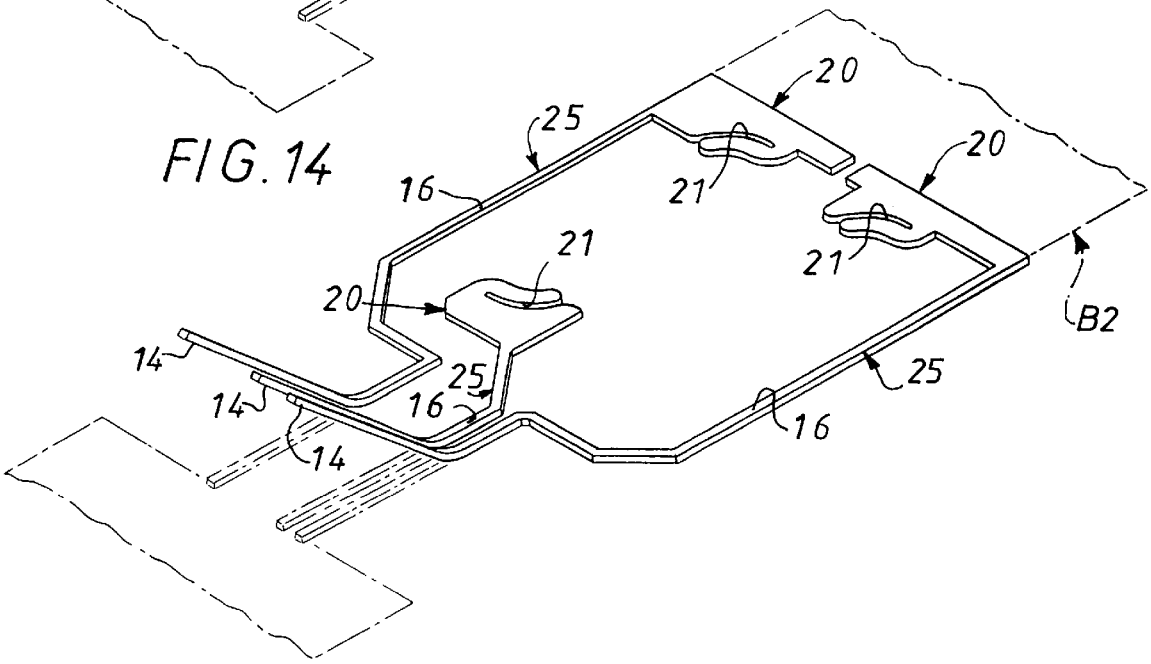
FIG. 14 is a perspective view of the other part of these blanks.

As shown diagrammatically in chain-dotted line in FIGS. 13 and 14, for example, the two layers between which the blanks 25 forming the various connection units 20 are divided are cut out from two separate strips B1, B2.

To facilitate conjoint manipulation of the blanks 25 obtained in this way from the same strip B1, B2, a weak part of the latter, common to all of the blanks 25 concerned, may be left temporarily in place, for example beside corresponding contact members 14, for subsequent removal after the blanks 25 are separated.

In the embodiment shown, the body 11 of the connection socket 10 of the invention has two parts 11A, 11B between which the blanks 25 forming the various connection units 20 are placed flat, namely a part 11A which receives the blanks 25 and has the receptacle 12 in its side and a part 11B on the surface of which the connection terminals 15 are accessible to the user.

The part 11A includes a plate 35 with which the part 11B is superposed and flanking one edge of the plate 35 a back 36 the height of which is much greater than that of the plate 35 and in which the receptacle 12 is formed.

In practise the plate 35 of the part 11A and the part 11B have the same contour, and this contour is rectangular.

The barrels 22 are freely confined rotationally between the plate 35 and the part 11B.

In the embodiment shown, the connection terminals 15 and therefore the barrels 22 are accessible to the user from the side of the part 11B.

To be more precise, in this embodiment, the part 11B of the body 11 comprises housings 37, the number of which is equal to the number of barrels 22, in which the head 28 of the barrels 22 is rotatably mounted, being axially braced therein by a transverse shoulder 38, and the plate 35 of the part 11A of the body 11 conjointly includes, in corresponding relationship, housings 39 in which the deflectors 30 of the barrels 22 can pivot, being braced axially therein by a shoulder 40.

As shown, the housings 37 and the housings 39 are on the top of a square, for example.

In the embodiment shown, axial projections 41 in the housings 39 in diametrally opposite positions relative to each other limit the range of angular movement of the barrels 22 in both directions.

In this embodiment, at least one of the component parts 11A, 11B of the body 11, and in practise each of them, has ribs 42A, 42B projecting from the surface facing the other one, to locate and to insulate the blanks 25 inserted between them.

In the case of the part 11B, the ends of two of the ribs 42B also locate and retain the insulative material plate 34.

In the embodiment shown, the connection terminals 15 and therefore the barrels 22 are accessible to the user from the side of the body 11 opposite the receptacle 12.

In other words, in this embodiment, the receptacle 12 is open on the same side as the bottom face of the plate 35 of the part 11A of the body 11.

However, as an alternative to this, the connection terminals 15 can equally well be accessible to the user on the same side as the receptacle 12.

They can equally well be divided between both sides.

In the embodiment shown, the two component parts 11A, 11B of the body 11 are simply clipped together.

To this end, the part 11B has two elastically deformable lugs 43 projecting along the edge in contact with the back 36 of the part 11A, each in the shape of a hook and each engaged in a respective one of two grooves 44 provided for this purpose on the back 36, until they engage with detents 45 provided for this purpose in the grooves 44.

Figure 2:
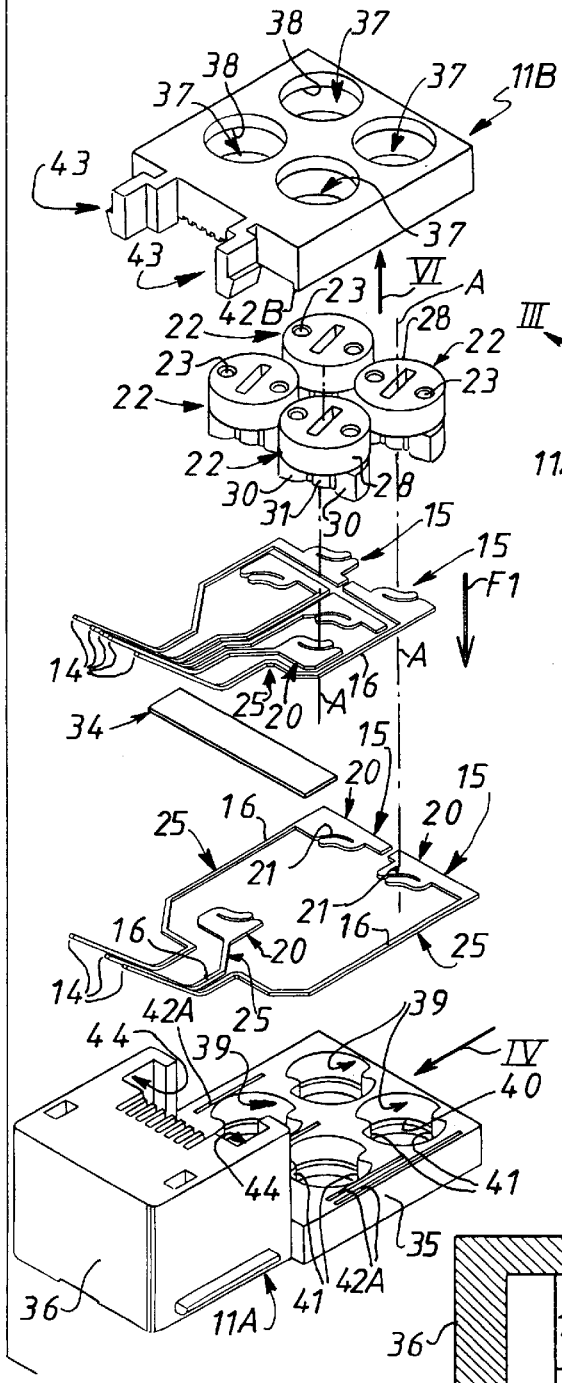
FIG. 2 is an exploded perspective view of it.

At assembly time, which merely involves stacking the part 11A of the body 11, the blanks 25 and, in the embodiment shown, the insulative material plate 34 between the two layers that they form, the barrels 22, with a slantwise presentation of the latter between the associated connection units 20, and the part 11B of the body 11, as shown diagrammatically by an arrow F1 in FIG. 2.

Alternatively, the two component parts 11A, 11B of the body 11 can equally well be welded and/or crimped together.

In service, the connection socket 10 in accordance with the invention is normally attached to a support, for example a wall, not shown, before or after it is wired.

Be this as it may, at the time of wiring, the two electrical wires 18 of the same pair 19 are normally engaged in the two passages 23 of the same barrel 22, as shown for one such pair 19 in FIG. 1.

As indicated by an arrow F2 in FIG. 11, the barrel 22 is then rotated about the corresponding axis A, as a result of which the two electrical wires 18 engaged with it are each respectively forced into the slot 21 of the two connection members 20 concerned, which locally strips the electrical wires 18 by local displacement of their insulative material sheath.

Because of the contact established in this way with the lips 26, 27 of the slot 21 in which they are engaged, the two electrical wires 18 engaged in this way with the same barrel 22 are each respectively connected electrically to two different electrical conductors 16 and therefore to two contact members 14 which, also separate, each respectively correspond to two different connection terminals 15.

Figure 15:
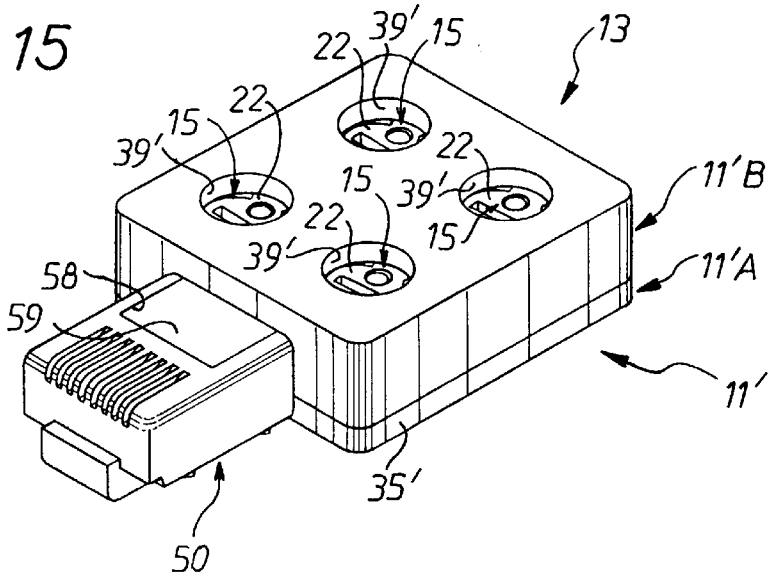
FIG. 15 is a perspective view of another connection unit of the invention.
Figure 17:
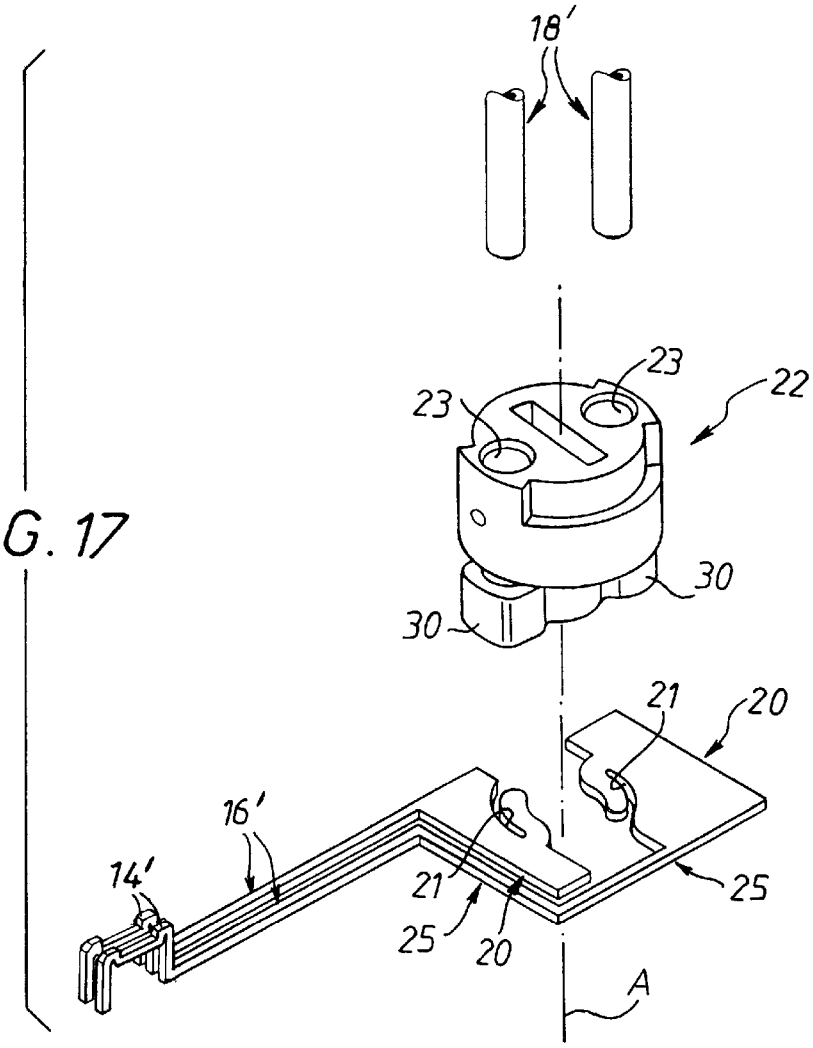
FIG. 17 is a perspective view to a larger scale of the blanks from which two of the connection members employed in this connection unit are made, together with the corresponding barrel.
Figure 16:
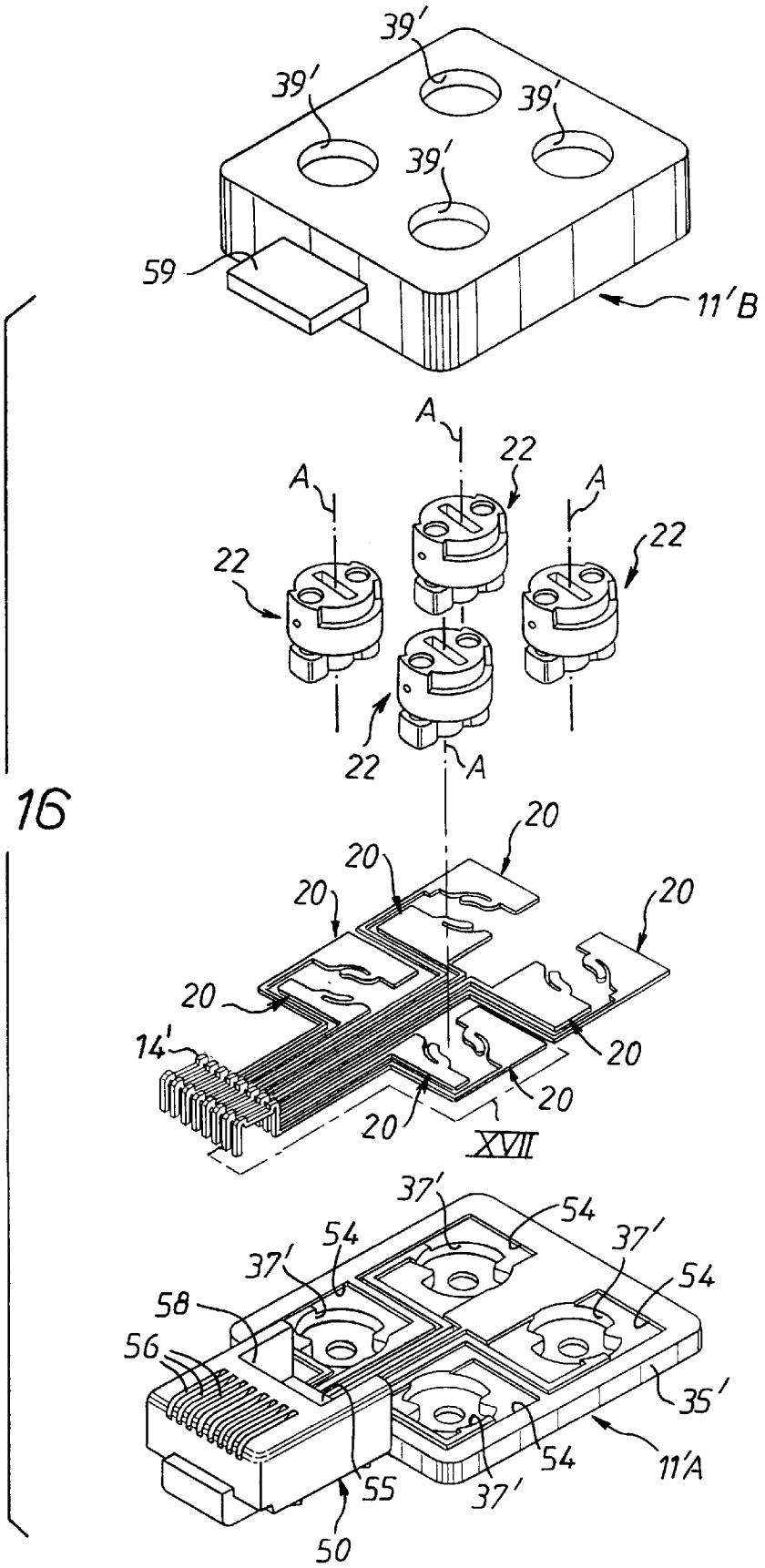
FIG. 16 is an exploded perspective view of it.

FIGS. 15 through 17 concern the situation in which the connection unit of the invention is a connection plug, for example the connection plug 13 constituting the conjugate connection unit associated with the previous connection socket 10.

As for the connection socket 10, the connection plug 13 includes, in a manner that is known in itself, for cooperation with the conjugate connection unit that is constituted by the connection socket 10, contact members 14' (FIG. 16) and, in an insulative material body 11', connection terminals 15 each individually connected to the contact members 14' by electrical conductors 16'.

By virtue of arrangements described in more detail hereinafter, the contact members 14' are operative within an end-piece 50 which projects from the body 11' and by means of which the connection plug 13 is adapted to be plugged into the connection socket 10, to be more precise into the receptacle 12 provided for this purpose in the connection socket 10.

As previously, there are eight connection terminals 15, which are identical to the connection terminals 15 of the connection socket 10.

For this reason they are designated here by the same reference numbers as the latter, and this applies to all of the components which are identical in the connection socket 10 and in the connection plug 13.

The connection terminals 15 of the connection plug 13 therefore each include, as previously, a connection member 20 having a circumferentially elongate slot 21 around an axis A and, coaxially associated with two connection members 20 circumferentially staggered about one such axis A, being in practise disposed at diametrally opposite positions relative to each other, a barrel 22 with passages 23 and deflectors 30, rotatable about the axis A and adapted to force an electrical wire 18' into the slot 21 of each of the two connection units 20 concerned.

In accordance with the invention, and as before, for at least one of the barrels 22 used, and in practise for each of them, the two connection members 20 associated with the barrel 22 are insulated from each other and each is respectively connected to two different contact members 14', with the result that the barrel 22 itself corresponds to two different connection terminals 15.

For the eight connection terminals 15 of the connection plug 13 there are therefore only four barrels 22, as previously.

Also as previously, the two connection members 20 associated with the second barrel 22 are flat and extend transversely relative to the corresponding axis A, each being respectively part of two metal blanks 25 conjointly forming, in themselves, and in one piece, the corresponding electrical conductors 16'.

In the case of a connection plug 13, the blanks 25 forming the various connection members 20 are coplanar and in a single layer in the embodiment shown.

However, as an alternative to this, they can be disposed in two layers, as previously, and/or superposed or assembled together, at least one of them being then at least locally insulated accordingly.

In the embodiment shown, the contact members 14' are each formed by localized, generally U-shaped deformation of the end of the corresponding electrical conductor 16' (FIGS. 16 and 17).

Also as previously, the body 11 of the connection lug 13 has, in the embodiment shown, two parts 11'A, 11'B, between which are disposed flat the blanks 25 forming the various connection members 20, namely a part 11'A which has a plate 35' forming a base and to which the end-piece 50 is joined laterally, in one piece, and a part 11'B forming a cover and on the surface of which the connection terminals 15 are accessible to the user.

In the embodiment shown, to receive the blanks 25 the plate 35' of the part 11'A includes housings 54 recessed relative to the surface of the part 11'A facing the part 11'B and, by virtue of arrangements of the same type as those previously described, the barrels 22 are freely confined rotationally between the plate 35' and the part 11'B.

As previously, the housings 37' provided for this purpose in the plate 35' of the part 11'A to receive the barrels 22 and those 39' provided in corresponding relationship in the part 11'B lie on the top of a square.

The end-piece 50 forms internally a housing 55 in which the electrical conductors 16' are engaged and which, in line with the contact members 14' carried by the latter, open to the outside via the slots 56, at the rate of one slot 56 per contact member 14', to render the contact members 14' accessible to the contact members 14 of the conjugate connection unit constituted by the connection socket 10.

In the embodiment shown, the slots 56 are open on the same side of the body 11 as the part 11'B of the latter.

In other words, in the embodiment shown, the connection terminals 15 of the connection plug 13 are accessible to the user on the side of the body 11 on which the contact members 14' are themselves accessible to the contact members 14 of the conjugate connection unit constituted by the connection socket 10.

However, as previously, the connection terminals 15 can be accessible to the user on the opposite side of the body 11, or divided between both sides of the latter.

As previously, the two component parts 11'A, 11'B of the body 11' can be clipped and/or welded, for example ultrasonically welded, and/or crimped together.

In the embodiment shown, the housing 55 formed by the end-piece is open through a notch 58 on the same side as the slots 56 and, to close it, the part 11'B carries a projecting tab 59 in corresponding relationship.

Of course, the present invention is not limited to the embodiments described and shown, but encompasses any variant execution.

In particular, if required any kind of supplementary connection terminal can be provided on a connection unit of the invention for connecting the connection unit to ground, and this may be, for example, an insulation displacement connection terminal of the type described and shown, or a simple, conventional screw connection terminal.

In the case of an insulation displacement connection terminal, there may be only one connection member associated with the corresponding barrel.

The electrical conductors operative between the connection members and the contact members can if required be exploited to create localized compensation devices and in particular capacitative devices to reduce near-end crosstalk.

Their path is therefore not necessarily that shown.

Also, if required, the barrels employed may be provided with markers to identify them.

For example, each may be colored using two different colors, for a total of eight colors corresponding to the applicable color codes.

For a connector including only four contacts, the plug may include only two barrels, in accordance with the invention, at the rate of one barrel per two contacts, but the socket may include one barrel per contact in the conventional way, if required, in order to enable tapping off.

Finally, whether it is a socket or a plug, the connection unit of the invention can if required be at least partially metalized in order to comply with shielding requirements, for example.

There is claimed:

1. A connection unit for transmission networks comprising contact members adapted to cooperate with a conjugate connection unit, an insulative material body, connection members being disposed in said insulative material body, said connection members being selectively electrically connected to said contact members, each of said connection members defining a circumferentially elongate slot around an axis, said connection members being arranged in pairs and circumferentially staggered around a corresponding common axis, a barrel being associated with each pair of said connection members and rotatable about the corresponding common axis, said barrel having a pair of passages for receiving respective electrical wires, said barrel being adapted to drive electrical wires received in said passages into electrical engagement in the slots of said connection members, said pair of connection members associated with at least one of said barrel being electrically insulated from each other and electrically connected to different ones of said contact members.

2. The connection unit claimed in claim 1, wherein said pair of connection members associated with said at least one barrel being flat and extending transversely relative to the corresponding common axis, said at least one barrel including a deflector defining a portion of said passages and extending beyond a level defined by said connection members.

3. The connection unit claimed in claim 2, wherein said at least one barrel includes a head portion, a central core extending axially from a bottom surface of the head portion, and two deflectors extending radially in opposite directions from said central core.

4. The connection unit claimed in claim 3, wherein said pair of connection members associated with said at least one barrel are disposed diametrically opposite each other, said passages in said barrel and including portions in said deflectors also being disposed diametrically opposite each other.

5. The connection unit claimed in claim 1, wherein said pair of connection members associated with said at least one barrel are respectively defined in two different blanks, said different blanks also defining electrical conductors electrically connected to said contact members.

6. The connection unit claimed in claim 1, wherein said connection members associated with all of said barrels are electrically insulated from each other and electrically connected to different ones of said contact members.

7. The connection unit claimed in claim 5, wherein said insulated material body comprises two component parts attached together, said blanks defining said connection members being disposed flatwise between said component parts, one of said parts receiving said blanks and the other of said parts providing user access to said connection members.

8. The connection unit claimed in claim 7, wherein at least one of said component parts has ribs projecting from a surface facing the other of said component parts, said ribs positioning said blanks disposed between said component parts.

9. The connection unit claimed in claim 7, wherein at least one of said component parts includes recesses set back relative to the surface facing the other of said component parts for receiving said blanks.

10. The connection unit claimed in claim 1, wherein said connection unit defines a connection socket, said contact members being operatively disposed in a receptacle adapted to receive a conjugate connection plug.

11. The connection unit claimed in claim 1, wherein said connection unit defines a connection plug, said contact members being operatively disposed in an end piece projecting from said body, said end piece of said connection plug being adapted to be plugged into a conjugate connection socket.

* * * * *